US011136168B2

(12) United States Patent
Luch et al.

(10) Patent No.: US 11,136,168 B2
(45) Date of Patent: Oct. 5, 2021

(54) PACKAGE WITH TAMPER EVIDENT SECURITY BAND

(71) Applicants: Daniel Luch, Morgan Hill, CA (US); Daniel Randolph Luch, Carmel, CA (US)

(72) Inventors: Daniel Luch, Morgan Hill, CA (US); Daniel Randolph Luch, Carmel, CA (US)

( * ) Notice: Subject to any disclaimer, the term of this patent is extended or adjusted under 35 U.S.C. 154(b) by 0 days.

(21) Appl. No.: 15/732,388

(22) Filed: Nov. 2, 2017

(65) Prior Publication Data

US 2018/0170627 A1 Jun. 21, 2018

Related U.S. Application Data

(63) Continuation-in-part of application No. 14/756,187, filed on Aug. 12, 2015.

(60) Provisional application No. 62/070,102, filed on Aug. 14, 2014.

(51) Int. Cl.

| | |
|---|---|
| ***B65D 41/34*** | (2006.01) |
| ***B65D 51/20*** | (2006.01) |
| ***B65D 47/08*** | (2006.01) |
| ***B65D 77/20*** | (2006.01) |

(52) U.S. Cl.

CPC ..... *B65D 41/3447* (2013.01); *B65D 47/08* (2013.01); *B65D 51/20* (2013.01); *B65D 77/202* (2013.01)

(58) Field of Classification Search

CPC ..... B65D 39/084; B65D 39/086; B65D 55/0818; B65D 45/30; B65D 41/3447; B65D 47/08; B65D 51/20

USPC ..... 220/214, 319

See application file for complete search history.

(56) References Cited

U.S. PATENT DOCUMENTS

| | | | | | |
|---|---|---|---|---|---|
| 2,037,923 | A * | 4/1936 | Punte | B65D 45/30 | 29/525.05 |
| 4,674,650 | A * | 6/1987 | Hamilton | B65D 43/0218 | 220/319 |
| 4,699,291 | A * | 10/1987 | Prais | B65D 45/30 | 206/1.5 |
| 4,895,266 | A * | 1/1990 | Begley | B65D 41/3428 | 215/230 |
| 5,145,079 | A * | 9/1992 | Woodrow | B65D 55/026 | 215/232 |
| 5,253,772 | A * | 10/1993 | Earnest | B65D 43/0297 | 220/270 |
| 5,573,134 | A * | 11/1996 | Chenault | B29C 57/12 | 215/250 |
| 5,582,318 | A * | 12/1996 | Dietrich | B65D 7/40 | 220/319 |
| 5,823,340 | A * | 10/1998 | Maihofer | A61L 2/26 | 206/370 |
| 5,881,898 | A * | 3/1999 | Irwin | B65D 1/16 | 220/319 |

(Continued)

*Primary Examiner* — J. Gregory Pickett
*Assistant Examiner* — Niki M Eloshway

(57) ABSTRACT

A package is produced having an external and highly visible tamper evidencing band which surrounds portions of both a container lip flange and the periphery of a closure lid. A distal portion of the band is mechanically formed using a forming tool to have an inwardly directed portion which cooperates with an inwardly directed band flange to securely hold the container and closure lid together. The band must be removed to successfully open the package.

20 Claims, 15 Drawing Sheets

(56) References Cited

U.S. PATENT DOCUMENTS

| | | | | |
|---|---|---|---|---|
| 5,964,367 | A * | 10/1999 | Przytulla | B65D 1/16 220/319 |
| 8,689,997 | B2 * | 4/2014 | Johansson | B65D 45/30 220/319 |
| 2010/0236966 | A1 * | 9/2010 | Luttik | B65D 21/022 206/508 |

* cited by examiner

PACKAGE WITH TAMPER EVIDENT SECURITY BAND

CROSS REFERENCE TO RELATED APPLICATION

This application is a Continuation-In-Part of U.S. patent application Ser. No. 14/756,187, filed Aug. 12, 2015 and titled Package With Tamper Evident Security Band, which claimed the benefit of priority to U.S. Provisional Patent Application No. 62/070,102 entitled Tamper Evident Band To Secure Lid To Container, filed on Aug. 14, 2014.

BACKGROUND OF THE INVENTION

Consumer packaging and industrial packaging each have their unique set of requirements and characteristics resulting from those requirements. The instant inventions teach methods and structure for improvements in consumer packaging.

The typical consumer package conveys product such as food, cosmetics and the like to a broad base of end users. As a result. the technology of consumer packaging is many faceted and encompasses many unique demands. Packages are normally relatively small, typically less than 1 to 2 gallons. Production of the packaging itself and combining with the contents is accomplished in high volumes using rapid, highly automated processing. Filling lines for consumer packages are often repetitively modified to rapidly fill multiple products requiring differing package sizes and types. Intrinsically. the packaging must be relatively inexpensive and a minor fraction of the total goods cost. Further, the package must be simple and understandable to a wide variety of consumers. The packaging itself is normally "single use" and discarded or recycled after use. Opening of most consumer packages is often preferably accomplished without additional tools. A further consideration to be addressed when considering consumer packaging is the nature of the contained product. Specifically, if the contents are fluid and "pourable", the package will normally include and opening of restricted orifice cross section to achieve controllable and directional pouring. In contrast, "non-pourable" materials such as solids and thick mixtures normally are conveyed in packaging having expanded opening such as cups, dishes and the like. Here the expanded cross sectional opening is approximate a major cross section of the container and allows facile dispensing of the more viscous or solid products.

A further expectation for consumer packaging is package security, especially for the packaging of personal items such as food and cosmetics. Typically this is accomplished by incorporating means giving the consumer evidence of initial package opening. A number of ways are currently employed to do this. These techniques can be generally characterized as "tamper evident" methods. Included in these methods are peelable seals, heat shrink bands, and frangible bands.

"Peelable" Seals

"Peelable" seals are membranes covering a package opening. These seals are sometimes referenced as "flexible lidding". The materials are typically membranes comprising multiple laminated layers, a first being an adhesive layer and a second being a "carrier" layer. The adhesive is normally chosen whose strength is adjusted to permit facile "peeling" during the initial package opening. The "carrier" layer may be an aluminum foil or a plastic such as polyethylene terepthalate (PET). During initial application of the seal to the package, the adhesive is often activated by heat such that the membrane adheres to the container upon cooling. "Peelable" seals are sometimes used as a single primary closure, especially for single serve packaging. However, if reclosure is desired, the "peelable" seal is normally combined with an additional lid or closure for use following initial opening.

"Peelable" seals are widely used and readily recognized by consumers. However, their application can limit line speeds and materials can be relatively costly, especially for large orifice packages. In addition, because the seals are most often produced by cutting from a sheetlike web, there may be considerable waste. When used alone, the "peelable" seal is normally restricted to single use packaging. Multiple use packages may require an additional reclosure lid, at increased cost. Further, when used with a reclosure lid or cap in multiple use packages, the inner "peelable" seal may be hidden by the reclosure lid, reducing the value of any printing and eliminating shelf visibility of the tamper evident function of the seal. In addition, some of the materials used for these "peelable" seals may present recycling concerns.

Tamper Evidencing Security Shrink Bands

Shrink bands generally envision positioning a polymeric film to surround a closure on a container and subsequently heating the band to "shrink" around the closure to envelop the peripheries of both the closure and container opening. Conceptually, the package can only be opened by first removing the band, thereby offering evidence of initial opening. Shrink bands are widely used and readily recognized by consumers.

Shrink bands are first applied to a package such that they surround the package component to be secured. The band is supported in relative position while being heated, such as by transport through a heated shrink tunnel. The band shrinks as a result of the heating to hug and envelop the component.

Plastic shrink bands typically have a small thickness of the order 0.002 inch (2 mil) to allow rapid heating and proper shrinkage. They are thus relatively flimsy. Moreover, when used to simply surround a lid for tamper evidencing, the band often has limited length in relation to diameter. These factors make the band hard to manage and position on the container prior to shrinking. Indeed, it is often required to manually place individual shrink bands onto a package. Further, the band must retain its position prior to shrinking. These factors, combined with the capacity of the heated "shrinking" equipment, can slow line speeds and add to cost. These issues become more of a problem with non-cylindrical shapes.

Another disadvantage to heat shrink bands is they typically comprise PVC, a material often considered as a contaminant to the bulk post consumer recycling stream.

Tamper evidencing shrink bands also suffer from some problems in practical use by the consumer. Unless perforated through the length, at added cost, they can be relatively difficult to remove without an auxiliary tool "Frangible Band" Structures In "frangible band" arrangements, a band on one component of a package interacts with structure on a second component of the package to ensure the integrity of the package until initial opening. Initial opening separates those components and simultaneously destroys a visible "frangible" feature on the band. In one variation, a separate band is applied which encompasses portions of both a container and closure lid.

Some of these techniques may be similar to the "heat shrink" process discussed above, but employ more rigid materials and correspondingly different application techniques. For example, U.S. Pat. No. 5,582,318 to Dietrich teaches a bung stopper/bunghole arrangement wherein a tightening element is employed to compress a sealing means between the bung stopper and a sealing surface on the neck of the container. The technique and structure taught by Dietrich '318 is directed to industrial packaging and clearly not appropriate for consumer packaging. Specifically, Dietrich refers to the "German Industrial Norm" for structural details of his package not detailed therein. Dietrich does specify that the bung receptacles addressed have an opening which is smaller than the inner diameter of the receptacle and intended for pourable contents. The sealing means taught by Dietrich is in the form of a separate, compressable gasket such as an "O-ring". Such a sealing means is inappropriate for high volume, low cost consumer packaging. Dietrich does not teach specifics on how the tightening element is applied except to say that it "may be attached by folding, flanging, or extruding". Regardless of how accomplished, the Dietrich embodiments show a substantially planar formed structure of the tightening element. Such processing performed on the large bung receptacles taught would be slow and tedious. Finally, Dietrich refers to the use of a specialized "pulling off tool" to remove the clamp band, a very detrimental feature for consumer packaging.

Many efforts have been made to combine multiple functions into a single component (like TE into the container or lid) in order to achieve simplification or cost reductions. One common method of achieving tamper evidence for a package is producing a container or a closure which includes an integral or monolithically formed frangible structure which is visually broken when the package is initially opened. Often the structure is in the form a band which interlocks with complimentary structure when the closure is initially applied to the container. In some cases the band is attached to a closure through frangible material "bridges" or a tearable "score line". The bridges or score line are severed during original closure removal. In other cases the integrally formed band is frangibly attached to a container vicinal its orifice and engages the initially applied closure such that the frangible attachment structure is severed on initial removal of the closure.

Frangible tamper evidencing structure has a number of advantages over alternative methods. The tamper evidencing afforded by frangible structure is normally highly visible prior to purchase, and is understood, recognized and accepted by most consumers. The engagement of the frangible structure often assists in retaining packaging components in proper combination during transport prior to initial opening. The frangible components are normally relatively rigid and easily managed prior to initial engagement which simplifies handling, filling and transport. There is normally minimum waste when using frangible structure and the frangible structure is normally formed from materials totally compatible with the bulk recycling stream.

When considering frangible structure, unique issues may come into play when addressing specific packages. For example, packaging involving relatively expansive upper openings such as cups, tubs and dishes is typically used for viscous products and solids. These types of containers are generally produced using high volume production methods of injection molding or thermoforming. Continual efforts are made to produce materials and package designs and fabrication improvements to increase cycling speeds and reduce material usage through "thin-walling". However, these efforts may also be contrary to proposals to incorporate integral structure into individual components to enhance package security and tamper evidence.

The special considerations of various container types has resulted in some unique prior art proposals to increase package security of containers such as tubs, cups and dishes with large upper openings. For example, U.S. Pat. No. 4,711,364 teaches a rigid container lid whose peripheral skirt must be fractured using a tool such as a screwdriver to allow the skirt to be deformed for removal. This reference also teaches an additional frangible band to hide the closure skirt to prevent tool access prior to removal of the frangible band.

U.S. Pat. No. 4,024,976 teaches a tamperproofing band molded integrally with and frangibly attached to the container with bridges or web. This band surrounds and shields the lid skirt when the cap is first applied to the container so that one cannot access the lower edge of the lid to pry up and remove. Thus, at least a portion of the tamperproofing band must be removed before the lid can be pried up and removed from the container.

Another approach to tamper evidencing using frangible bands is to mechanically form a frangible band to produce structure engageable with complimentary structure on another component of the package. This engagement causes fracture of the frangible band on initial opening of the package. The conceptual technique of mechanical forming of plastic materials is known. The relatively low softening point of many plastics assists in such operations due to the ability to rapidly heat and cool a structure to its softened or "formable" state. Processing such as curling, rolling and stamping of material is practiced in the packaging art. For example, rolling upper lips of plastic or paper drinking cups is commonplace. Also, applying a concave tool to the distal edge of a cylindrical plastic member to produce a curled structure is shown in numerous patents to Thompson, such as U.S. Pat. Nos. 4,708,255; 4,709,824; 4,793,506; 4,872,304; 4,823,967; 4,811,857; 4,856,667, 4,925,617 and 5,158,195. These patents disclose a curled band frangibly attached to a screw closure which is resilient and engages a container neck when the closure is applied. The band separates from the closure when it is initially removed from the container.

U.S. Pat. No. 5,573,134 to Chenault, et al. discloses a container and closure combination wherein a cylindrical band monolithically formed integrally with the container is initially molded as a straight-wall cylinder spaced outwardly of the lip of the container and connected to the container by frangible bridges. The band is subsequently curled inwardly by application of a heated curling tool, either before or after the container lid is applied. The curl of the band prevents removal of the lid without fracture of the bridges and/or removal of the tamper-evident band. Despite ensuring excellent product integrity and highly detectable tamper evidencing, commercial application of the teachings of U.S. Pat. No. 5,573,134 were thwarted by a number of complications. First, forming a tamper band monolithically joined with the container through a frangible connection introduced significant complications, many unforeseen. Specifically, plastic injection molding was a preferred method of producing such an article. Other options, such as thermoforming, stamping and paper fabrication appeared less viable. However, the outboard tamper band had to be "filled" with molten plastic through the frangible connection having restricted cross section for flow. This factor limited ability to reduce container wall thickness, reduced design flexibility and required increases in injection pressures. Moreover, the design complication and increased injection pressures implicit in this concept resulted in large, very complicated molds and reduced cavitation. The desired features of the band (curlability, color and design) sometimes conflicted with the material and design requirements of the container. For example, materials exhibiting good forming ability ("curlability") may not be optimal for forming the container itself. Further, having an outboard, frangibly connected band complicated other secondary processing such as handling and printing the container. Finally, employing an integral band formed monolithically with the container effectively eliminated some processing options (such as thermoforming the container), and materials (such as paperboard containers).

The terms and nomenclature used within this specification are employed according to their plain meaning. Nevertheless, in order to promote clarity to the teachings and claims of the invention, the following definitions for specific terms employed are supplied.

"Integral" means essential to completeness of the whole.

The terms "monolithic" or "monolithic structure" are used as is common in industry to describe structure that is made or formed from a single or uniform material. An example would be a "boat having a monolithic plastic hull".

"Mechanical forming" is used here to indicate a process whereby a material "preform" is permanently deformed in its solid state to a desired final shape. Mechanical forming is accomplished using a forming tool. Normally the forming tool is heated and possibly the material is mildly heated to below its melting point during mechanical forming. Depending on the tool design, process conditions, materials etc. a wide range of structures can be produced using mechanical forming.

"Curling" designates a mechanical forming process whereby a curved structure is produced.

"Overlapping" identifies a condition wherein a portion of a first structure either completely or partially overlies, underlies or covers another structure. Overlapping may comprise either complete or partial coverage.

"Polymers" are materials comprising large molecules of multiple repetitive structural units (mers). Many polymers are commonly referred to as plastics. Polymers comprise a broad class of materials having a wide variety of chemical, physical and mechanical properties. Most common polymers are carbon based (organic polymers) or silicon based (for example silicone materials).

"Mer" is a unit of chemical structure which is repeated multiple times in a combined molecule (polymer).

"Polymeric" refers to a material or structure comprising a polymer.

"Organic" materials are those based on or having a significant portion of their structure and characteristics defined by carbon. "Inorganic" materials are those substantially absent carbon although some "inorganic" materials may comprise carbon in small amounts.

When referring to an object, "top", "upper" "upwardly", "bottom", "lower", "downwardly", "over", "under", "above", "below", "vertical" and "horizontal" and similar terms describe spatial characteristics of an object when the object is in its orientation at rest or during normal distribution and use.

"Opening", when describing a package, refers to the area through which product is removed from the package.

"Lid" and "closure" are terms for on object intended to cover the opening of a container. Often "lid" and "closure" may be used interchangeably.

"Substantially" means being largely or wholly that which is specified.

"Essentially" means fundamentally or "for all intents and purposes".

A "pattern" is a design or arrangement.

"Direct physical contact" means "touching".

"Selectively positioned" means that which is specified is positioned in a preselected arrangement or design.

"Terminal edge" or "distal edge" is a boundary outside of which there is none of that which is specified.

A "self supporting" structure is one that can be expected to maintain its integrity and form absent supporting structure.

"Portion" means a part of a whole item. When used herein, "portion" may indicate 100 percent or less of the whole item (i.e. 100 percent, 90 percent, 80 percent, 70 percent, 60 percent, 50 percent, 40 percent, 30 percent, 20 percent, 10 percent 5 percent, and 1 percent).

A "film" refers to a thin material form having length and width much greater than its thickness that may or may not be self supporting.

A "continuous form" of material is one that has a length dimension far greater than its width or thickness such that the material can be supplied or produced in its length dimension without substantial interruption.

The term "multiple" is used herein to mean "two or more".

An "adhesive" is a material that can bond to a surface or object.

A "laminating adhesive" is an adhesive material in the form of a layer or film. The adhesive will typically be activated using heat or pressure or a combination of both.

"Adhesive affinity" is a characteristic of a material's ability to adhesively bond to a mating surface. A material has "adhesive affinity" for a mating surface if it can form or has formed an adhesive bond directly to that surface using appropriate adhesive processing.

"Substantially planar" or "essentially planar" characterize a surface structure which may comprise minor variations in surface topography but from an overall and functional perspective can be considered flat.

A "preform" is an object characterized in that it can be formed into a desired object by subsequent processing following its initial production.

"Outer" is an adjective describing a point on an object not completely surrounded by additional material forming the object.

"Inner" is an adjective describing a point on an object completely surrounded by additional material forming the object.

A "thermoplastic" material is one that becomes fluid and can flow at an elevated temperature. A thermoplastic material may be relatively rigid and non-tacky at room temperature and "melts" (becomes fluid) at elevated temperature above ambient.

A "structural polymer" is a polymer or plastic that can provide structural support, often to overlying or underlying structure. A "structural polymer" may also be referred to as a "polymeric support" or a "polymeric carrier".

"Heat sealing" is a process of attaching two forms together using heat. Heat sealing normally involves softening of the surfaces of one or both forms to allow material flow and bond activation. "Heat sealing" can involve a simple welding of two similar materials or may employ an intermediary adhesive to bond (seal) the two materials to each other.

"Laminating" is a process involving the mating of two or more surfaces. It normally involves partial or complete overlapping of two or more material bodies. The bodies normally have a "sheetlike" form such that the laminating process positions the "sheetlike" forms relative to each other as a layered combination. Laminating often involves the activation of an intermediary "laminating" adhesive medium between the "sheetlike" forms to securely attach the layers to each other. Activation of the "laminating" adhesive is normally accomplished using heat and/or pressure to cause the adhesive to soften and flow to "wet" and intimately contact the mating surface.

When describing an object, the adjective "flexible" means that the object may be significantly deformed without breaking. An object may often be flexible because one of its dimensions such as thickness is small. In addition, flexibility is often, though not always, accompanied by elasticity in that the object is not necessarily permanently deformed by bending and can be returned to substantially its original shape after being deformed.

The terms "preponderance" or "major portion" designate a quantity greater than fifty percent (i.e. 50%, 60%, 70%, 80%, 90%, 95%, 100%).

"Substrate" is a structure that can provide support.

"Periphery" means the outer limits or edge of an area or structural feature.

"Segmented" means comprising individual unique and identifiable portions

OBJECT OF THE INVENTION

An object of the invention is to provide an improvement in consumer packaging.

SUMMARY OF THE INVENTION

The instant invention provides an improvement in providing for consumer package security. The instant invention contemplates forming a tamper evident security band from a "preform" capable of being mechanically formed. A portion of the band is mechanically formed (typically "curled") producing structure such that the band securely retains a closure lid over a container opening. The band thus formed must be removed prior to removing the lid. Thus the formed band serves a dual function of securing the lid to the container and providing highly visible tamper evidence prior to initial package opening.

The band is originally produced separate from the container, either integrally attached to the lid or separate from both lid and container.

In light of the teachings to follow herein, one skilled in the art will recognize numerous advantages for this novel invention. First, the technology taught herein eliminates the complications and deficiencies of prior art methods. Specifically, the instantly taught bands can comprise portions that are uniquely colored, printed, embossed or otherwise designed for distinctiveness and branding. Designs such as texture or lettering can be "molded-in". The bands may be formed from materials that are totally recyclable. The bands may be employed on a wide variety of containers, including those made of materials such as paperboard or glass. The bands are relatively rigid and self supporting and therefore can be readily mechanically handled, sorted and applied in high speed fashion. Further, they are appropriate for wide mouth packages or those of non-uniform or non-circular shape. Depending on processing and tooling and band design, a wide variation of structures are possible for the final formed band, allowing distinctiveness and shelf attraction.

While not intended to be totally inclusive, some of the embodiments of the invention are described below.

An embodiment of the invention is an article comprising a container, a closure and a security band wherein a mechanically formed band portion overlaps a portion of the container such that the band must be removed to disengage the closure from the container.

An embodiment of the invention is an article comprising a container, a closure and a security band wherein a mechanically formed band portion overlaps a portion of the closure such that the band must be removed to disengage the closure from the container.

An embodiment of the invention is an article comprising a container, a closure and a distinct and separate band wherein a first portion of the band has mechanically formed structure which overlaps with a portion of the container and a second portion of the band has unaltered structure produced by injection molding.

In an embodiment a portion of a band overlapping with a portion of a container has a mechanically formed structure.

In an embodiment a portion of a band overlapping with a portion of a lid has a mechanically formed structure.

An embodiment of the invention is an article comprising a container having a lip, a closure and a security band comprising a mechanically formed portion extending beneath the container lip.

In an embodiment of the invention, a security band monolithically combined with a closure has a mechanically formed portion that extends beneath a lip of a container.

An embodiment of the invention comprises a combination of a container, a closure and a mechanically formed security band wherein the closure and band comprises different materials.

An embodiment of the invention comprises a combination of a container, a closure and a mechanically formed security band wherein the closure and band comprise different polymers.

An embodiment of the invention comprises a combination of a container, a closure and a mechanically formed security band wherein the materials forming the closure and band both comprise polymers having the same chemical mer, and wherein the physical properties of the materials forming the closure and band differ.

An embodiment of the invention comprises a combination of a container, a closure and a mechanically formed security band wherein the container and band comprise different materials.

An embodiment of the invention comprises a combination of a container, a closure and a mechanically formed security band wherein the container and band comprises different polymers.

An embodiment of the invention comprises a combination of a container, a closure and a mechanically formed security band wherein the materials forming the container and band both comprise polymers having the same chemical mer, and wherein the physical properties of the materials forming the container and band differ.

An embodiment of the invention comprises a combination of a container, a closure and a mechanically formed security band wherein the container, closure and band all comprise polymers having the same mer.

An embodiment of the invention comprises a combination of a container, a closure and a mechanically formed security band wherein the container comprises paper.

An embodiment of the invention comprises a combination of a container, a closure and a mechanically formed security band wherein the lid comprises paper.

An embodiment of the invention comprises a combination of a container, a closure and a mechanically formed security band wherein the band comprises paper.

An embodiment of the invention comprises a combination of a container, a closure and a mechanically formed security band wherein the band comprises a polyolefin.

An embodiment of the invention comprises a combination of a container, a closure and a mechanically formed security band wherein the band comprises polypropylene or polyethylene.

An embodiment of the invention comprises a combination of a container, a closure and a mechanically formed security band wherein the band has structure to facilitate manual removal without tools.

An embodiment of the invention comprises a combination of a container, a closure and a mechanically formed security band wherein the band has frangible structure allowing facile separation of the band from the container and lid.

An embodiment of the invention comprises a combination of a container, a closure and a mechanically formed security band wherein the band has a tear tab to allow gripping of the band to promote facile removal of the band from the lid and container.

In an embodiment of the invention a container, a closure and a mechanically formed band are combined wherein the container is injection molded.

In an embodiment of the invention a container, a closure and a mechanically formed band are combined wherein the container is thermoformed.

In an embodiment of the invention a container, a closure and a mechanically formed band are combined wherein the container is stamped.

In an embodiment of the invention a container, a closure and a mechanically formed band are combined wherein the band is injection molded.

In an embodiment of the invention a container, a closure and a mechanically formed band are combined wherein the band has a color different than the closure.

In an embodiment of the invention a container, a closure and a mechanically formed band are combined wherein the band comprises a portion which is printed, embossed or includes a molded-in design.

In an embodiment a container, a closure and a band having a distal edge are combined, and wherein either the container or closure comprises structure intended to shield or hide the distal edge of the band.

In an embodiment of the invention a package comprising a container, a closure and a mechanically formed band is produced absent materials which would function as contaminants to the post consumer recycling stream.

In an embodiment of the invention a package comprising a container, a closure and a mechanically formed band is produced absent polyvinyl chloride (PVC).

In an embodiment of the invention a package comprising a container, a closure and a mechanically formed band is produced wherein the container comprises a layer of barrier material.

In an embodiment of the invention a package comprising a container, a closure and a mechanically formed band is produced wherein either the container or closure is thermoformed or stamped and includes a layer of barrier material.

An embodiment comprises a process whereby a portion of a band is mechanically formed to produce a bent or curled structure which overlaps a portion of either a container or a lid.

In an embodiment a process mechanically forms a portion of a band to extend beneath a projecting lip of a container, and wherein said band is monolithically joined through a line of weakness to a lid dimensioned to cover the access opening to the container.

In an embodiment of the invention a package comprising a container, a closure and a mechanically formed band is produced wherein the container and closure have individual peripheral portions which are of approximately the same outer dimension and are positioned in proximity to each other, and wherein the band of mechanically formable plastic is positioned so that the band fits around the outside edges of the container and lid, and wherein a first portion of the band is mechanically formed to a structure extending above the peripheral container portion, and wherein a second portion of the band extends below the peripheral container portion.

In an embodiment of the invention a package comprising a container, a closure and a mechanically formed band is produced wherein the container and closure have individual peripheral portions which are of approximately the same outer dimension and are positioned in proximity to each other, and wherein the band of mechanically formable plastic is positioned so that the band fits around the outside edges of the container and lid, and wherein a first portion of the band is mechanically formed to a structure extending beneath the peripheral container portion, and wherein a second portion of the band extends above the peripheral container portion.

In an embodiment of the invention a package comprising a container, a closure and a mechanically formable band wherein the container and closure comprise mutually engageable structure to facilitate reclosure.

In an embodiment a separately prepared plastic security tamper band for a package is manufactured separately from other package components using injection molding.

In an embodiment a separately prepared security tamper band is automatically positioned onto an assembly of container and lid prior to mechanically forming a portion of the band to secure the band to the assembly.

In an embodiment a separately prepared security tamper band comprises structure to enable stacking of the bands.

An embodiment of the invention is an article comprising a container having a container opening surrounded by a container lip or flange, a closure and a tamper evident security band wherein a first portion of the band has mechanically formed structure which overlaps with a portion of the container lip, and wherein the container opening is non-circular.

In an embodiment of the invention a security band and lid are joined together in combination prior to application to a container and mechanical forming of a portion of the security band.

In an embodiment multiple combinations of security band and lid are assembled and accumulated prior to application to corresponding containers.

In an embodiment, mechanical forming of a tamper band portion is accomplished using linear, unidirectional movement of a forming tool relative to the band absent rotary motion.

In an embodiment, mechanical forming of a tamper band portion is accomplished using a combination of linear, unidirectional movement and rotary movement of a forming tool relative to the band.

In an embodiment, mechanical forming of a tamper band is accomplished without any radial or inward movement of a forming tool relative to the band.

BRIEF DESCRIPTION OF THE DRAWINGS

The accompanying drawings, which form a part of this specification, illustrate embodiments of the invention and, together with the description, serve to explain the principles of the invention.

DESCRIPTION OF PREFERRED EMBODIMENTS

Figure 1:
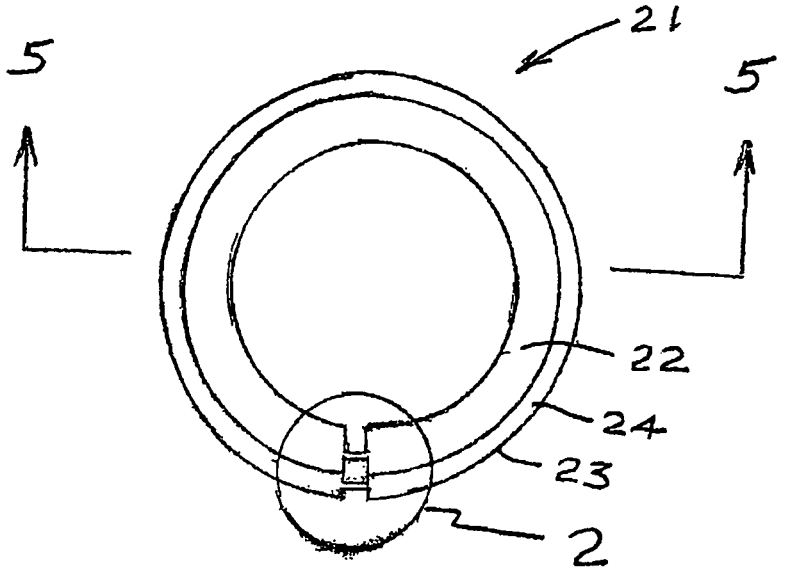
FIG. 1 is a top view of an embodiment of a security band of the invention as molded and prior to forming.

Reference will now be made in detail to preferred embodiments of the invention, examples of which are illustrated in the accompanying drawings. In the drawings, like reference numerals designate identical, equivalent or corresponding parts throughout several views and an additional letter designation is characteristic of a particular embodiment.

Figure 2:
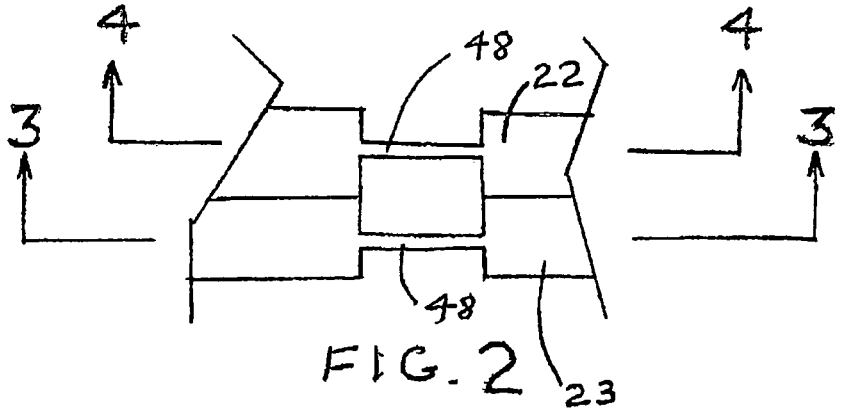
FIG. 2 is an exploded view of the portion of FIG. 1 within the circle designated "2".
Figure 3:
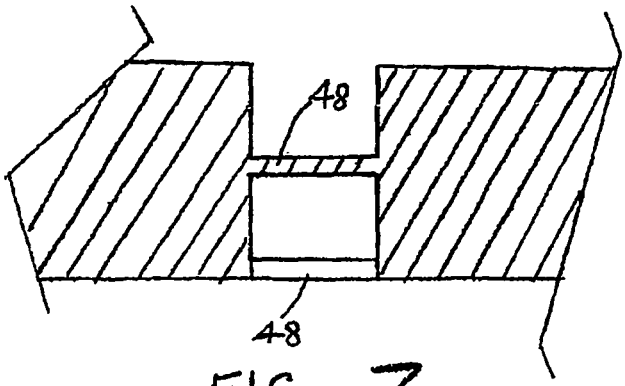
FIG. 3 is a sectional view taken substantially along the lines 3-3 of FIG. 2.
Figure 4:
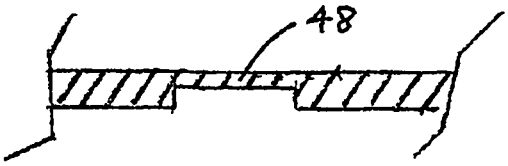
FIG. 4 is a sectional view taken substantially along the lines 4-4 of FIG. 2.
Figure 5:
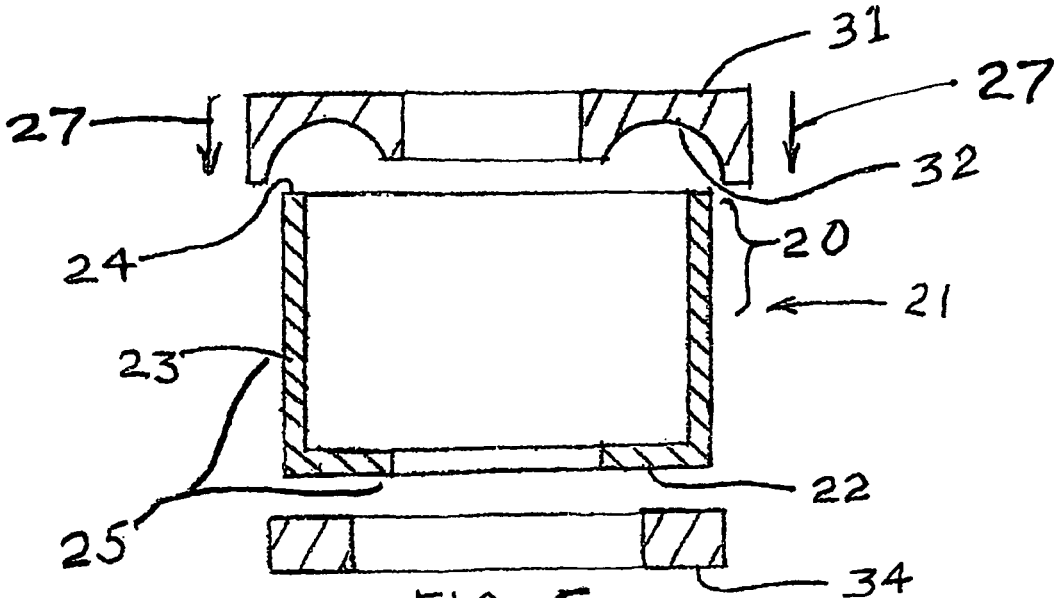
FIG. 5 is a sectional view of a band taken substantially along the lies 5-5 of FIG. 1 along with schematic representation of typical tooling used to accomplish mechanical forming or "curling" of a first portion of the band.

FIGS. 1 through 5 depict an embodiment of the invention. FIG. 1 shows a top view of a polymeric band 21 as initially formed and prior to mechanical forming. FIG. 2 is an exploded view of the portion of FIG. 1 within the circle designated "2". FIG. 3 is a sectional view taken substantially along the lines 3-3 of FIG. 2. FIG. 4 is a sectional view taken substantially along the lines 4-4 of FIG. 2. FIG. 5 is a sectional view of a band taken substantially along the lies 5-5 of FIG. 1. FIG. 5 also includes a schematic representation of typical tooling used to accomplish mechanical forming or "curling" of a first portion of the band.

Referring first to the FIG. 1 embodiment, there is shown a security band having generally round structure. In light of the teachings to follow, one will realize that the security bands of the instant invention may be of shapes other than round, such as substantially rectangular, oval or even irregular or "wavy" shapes. The actual shape will be as directed by the final overall package. Those skilled in the art will recognize that this design flexibility can be a major advantage compared with alternate forms of achieving tamper evidencing such as shrink bands.

Referring now to FIG. 5, there is shown a sectional view of the band 21 taken from the perspective of lines 5-5 of FIG. 1. Band 21 has structure and is formed from material which may be mechanically formed (in this embodiment "curled"). Suitable materials include many plastics, materials comprising plastics and certain paper materials. One notes that FIG. 5 also includes schematic representation of mechanical forming tooling to be discussed below in this specification. Continuing reference to FIGS. 1 and 5 shows that band 21 has a vertical wall 23 and an annular, inwardly directed annular flange 22. Band 21 comprises a "first portion" generally indicated by numeral 20. "First portion" 20 terminates in a distal end or edge 24. Portion 20 has characteristics such as design and thickness designed to allow facile mechanical forming such as will result in a "curled" structure as taught herein. Typically, portion 20 has a thickness greater than about 0.002 inch (i.e. 0.002 inch, 0.005 inch, 0.010 inch 0.020 inch). Thus the bands of the current invention are typically thicker than typical thickness for "shrink wrap" bands. This increased thickness is employed to produce precise mechanically formed geometries using the processing such as taught in FIG. 5. In addition, the thickness and structure of the bands of the invention, such as embodied in FIGS. 1 and 5, impart stiffness to the bands such that they can be machine handled, sorted, oriented and applied automatically at high speeds. Band 21 also comprises a "second portion" generally indicated by 25. In the FIG. 5 embodiment, "second portion" 25 comprises flange 22 and a portion of the wall 23 extending upward from flange 22. As will be seen, "second portion" 25 may remain unaltered during incorporation of security band 21 into the final assembled package, although this is not necessarily the case. However, if a portion remains unaltered, this facilitates either molded in or applied design of informational material such as ingredients, precautions, or aesthetics to be incorporated on that portion. Such informational material would be highly visible to the consumer. One will appreciate that the band structure of FIGS. 1 through 5 can be produced using standard plastic processing techniques such as injection molding.

One means whereby the band may be mechanically formed is also illustrated in FIG. 5. There, a tool 31, possibly heated, having a curved undersurface 32 is brought in contact with the distal edge 24 of band portion 20 and the backup tool 34 engages the underside of band flange 22. Tool 31 is advanced with unidirectional motion toward backup tool 34 as indicated by arrows 27, thereby causing the first band portion 20 to curl or bend inwardly into the positions shown in FIG. 6. In most, but not all, cases the unidirectional motion of the forming tool is vertical as indicated in the FIG. 5. In addition to the tool movement indicated in the FIG. 5 embodiment, one may also consider relative rotational motion (a combination of linear and rotational motion) when contacting the tool 31 and band portion 20. Rotational motion is relatively simple for circular bands and containers. For odd-shaped containers such as oval or rectangular, one realizes that more complex equipment designs may be required to achieve relative horizontal motion. Fortunately, it has been found that simple relative unidirectional motion between the band and the curling tool is generally suitable for producing satisfactory curled forms. However, the invention is not restricted to using simple relative unidirectional motion to produce the curled structure.

Figure 6:
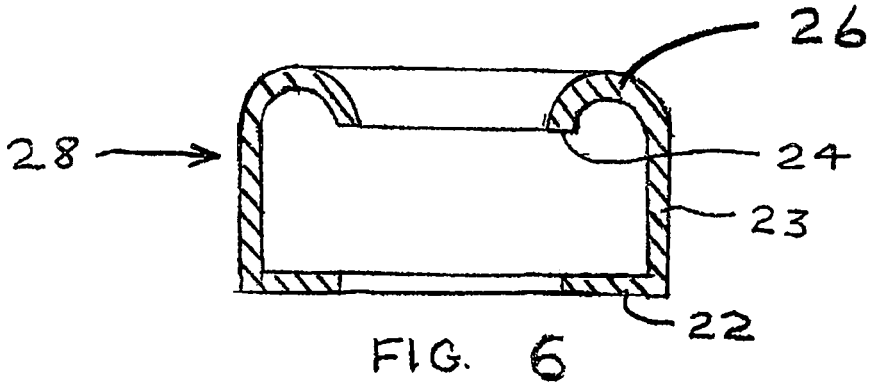
FIG. 6 is a sectional view showing the security band as formed by the mechanical forming process indicated in FIG. 5.

Referring now to the FIG. 6, the band is identified by the numeral 28 to reflect the altered "curled" structure, and the first portion of band, now curled, is indicated at 26. A number of different geometries may be produced by the mechanical forming. These geometrical possibilities result from a broad range of possible complimentary tooling and band characteristics. The application times and temperatures of the tool 31, the shape of surface 32, as well as the design of the band itself, are subject to considerable variation and therefore the final geometry of the mechanically formed band may also be varied considerably. For example, rather than the curved or curled shape shown in FIG. 6 at 26, the band wall portion 20 may be caused to assume a substantially flat horizontal orientation approximately parallel to the band flange 22.

Figure 7:
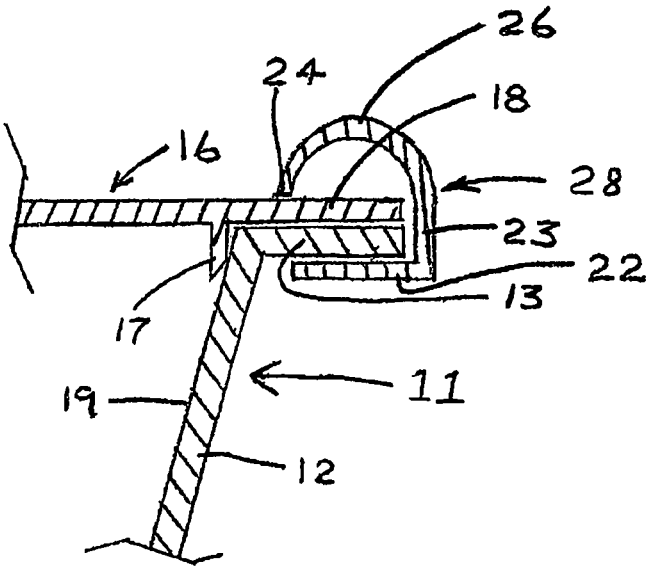
FIG. 7 is a sectional view through a portion of a container, a container lid or closure and security band with a curled first band portion extending above the top surface of a lid.

Turning now to FIG. 7, an embodiment comprising a combination of three initially separate package components is illustrated. There container 11, which may be of any convenient shape, has a body 12 terminating at its upper open end in an outward directed lip or flange 13. One will realize the container lip may take various forms, such as the annular flange depicted or a common rolled lip form. In some cases an outward directed lip structure may be absent. In the FIG. 7 embodiment, a lid 16 has been applied over the upper opening of container 11. Lid 16 may have a depending inner skirt 17 engaging the upwardly extending inner side wall 19 of body 12 to hold the lid in place before the band 21 is curled or possibly after the package is initially opened and the lid recloses the package. Depending skirt 17 may also contribute to achieving a seal between the lid and container. Such an arrangement is often referred to as a variant of a "plug seal". In many cases of consumer packaging, such a "plug seal" is a very cost effective way of package sealing, avoiding more costly methods such as gaskets of foil seals. In the embodiment of FIG. 7, lid 16 has a peripheral flange 18 having approximately the same outside diameter as container flange 13. As shown in FIG. 7, the distal "first portion" 20 of band wall 23 is mechanically formed into an inwardly curled structure 26 so that distal end 24 is proximal the upper side of lid flange 18. The curled "first portion" 20 transitions into a substantially unaltered vertical wall portion which extends to inwardly directed flange 22 positioned beneath container flange 13. The band wall 23 envelops the outside peripheral edges of flanges 13 and 18. Band flange 22 also remains substantially unaltered from its original structure. The residual unaltered band portions and sharply formed "curls" of the invention clearly distinguish the bands of the instant invention from the rumpled appearance of many shrink wrap bands.

It will be understood that container 11 and lid 16 may be made of many various materials which, as is well known, may differ. Band 28 comprises a formable material which, upon application of a proper tool thereto, may allow forming into a curled, rolled or bent structure. As previously noted, a number of choices exist for the band material. Polyolefin polymers have been determined to be particularly suitable for the band material. Polyolefin resins can be effectively mechanically formed as envisioned by the invention. In addition, many containers and lids employed in the practice of the invention comprise polyolefin resins and therefore all package materials may be totally compatible from a recycling standpoint and add to an already existing large recycling stream. Other techniques such as shrink bands and multi-material laminated peelable seals do not enjoy such an advantage.

In preferred embodiments, the band 28 is initially formed as shown in FIGS. 5 and 6. The band has an inward directed band flange 22 designed and sized to fit under (or over as subsequently taught herein) the container flange or lip 13 and having a band wall 23 projecting at an angle thereto and designed and sized to surround flanges 13 and 18. In a typical process in practice of the invention, the container 11 is filled and then the lid 16 and unformed band 21 (i.e. the band such as shown in FIGS. 1 and 5 prior to mechanical forming) are brought together with appropriate positioning. A mechanical forming tool such as illustrated in FIG. 5 is then activated to mechanically form the band wall such that it is bent or curled over (see FIGS. 6-8) or under (see FIGS. 13-25 and associated discussion) peripheral structure such as mating flanges on the container and lid.

Figure 8:
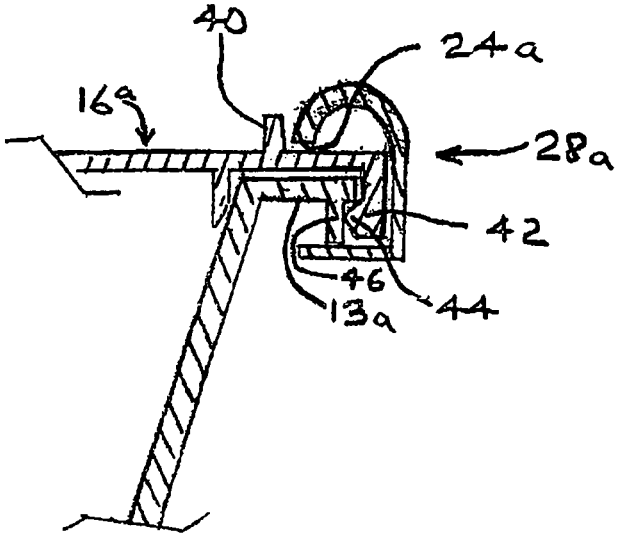
FIG. 8 is a sectional view similar to FIG. 7 illustrating further features of the invention.

Turning now to the sectional view of FIG. 8, additional features of the invention are illustrated. In the FIG. 8 embodiment, an upwardly projecting lid wall 40 is shown. The distal edge **24*a* of the curled band 28*a* resides in close proximity to the lid wall 40. With this arrangement, the lid wall 40 shields the distal edge 24*a*** to impede an unscrupulous individual from improper removal of the tamper band.

Continuing reference to FIG. 8 shows an additional feature. In the FIG. 8 embodiment, lid **16*a* comprises a depending skirt 42 surrounding the container flange 13***a*. Skirt 42 has an inwardly directed projection 44 which engages beneath the outer edge of the container flange 13*a* as shown. The interaction of the projection 44 and container flange may hold the lid in the closed position prior to curling of the band 28*a* and also allow secure reclosure after band removal.

Continuing reference to FIG. 8 shows an additional feature. In the FIG. 8 embodiment, a downwardly directed wall 46 depends from the lower surface of container flange 13*a*. Wall 46 provides support for maintaining the band and lid in proper position during the mechanical forming of curling step. In addition, wall 46 shields the lid skirt 42 prior to band removal.

Turning now to FIGS. 2-4, there is embodied additional features of the security band 21. FIG. 2 shows an enlargement of the encircled structural region labeled "2" in FIG. 1. FIGS. 3 and 4 are sectional views taken substantially along the lines 3-3 and 4-4 of FIG. 2 respectively. FIGS. 2-4 show a frangible structure comprising a discontinuity in the band structure bridged by two frangible links or bridges 48. Bridges 48 may be broken by the initial consumer to remove the band. Importantly, broken bridges signal that the band integrity has been violated and thereby gives highly visual external tamper evidence. While not shown in the simplified depiction of the frangible section of FIGS. 2-4, one will realize that inclusion of a widely recognized and employed gripping tab (or tear tab) may be attached to the band adjacent the band discontinuity to facilitate band removal by the initial legitimate consumer. This is an important advantage over shrink bands which, unless perforated, may require an additional tool for removal. One also recognizes that other forms of frangible connection such as thinned score lines may be employed. Also, the frangible region may be distinct, such as a patch, and need not be monolithic with the material of the remainder of the band.

Figure 9:
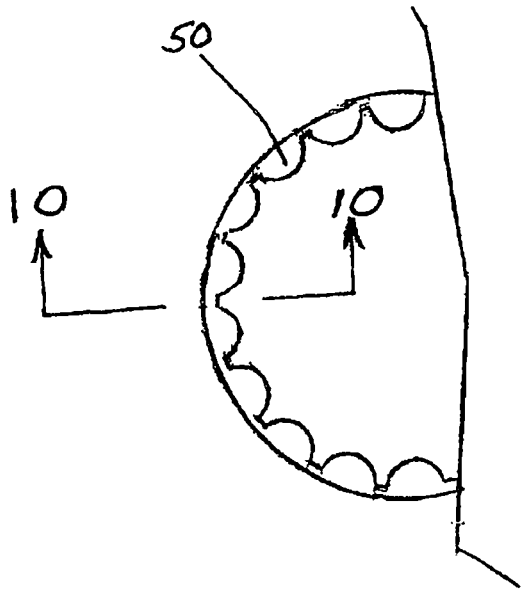
FIG. 9 is a top plan view of a portion of a assembly comprising a container, a lid, and a formed band showing different structure for the band wherein the band has a segmented or "scalloped" structure to permit a flatter formed structure.
Figure 10:
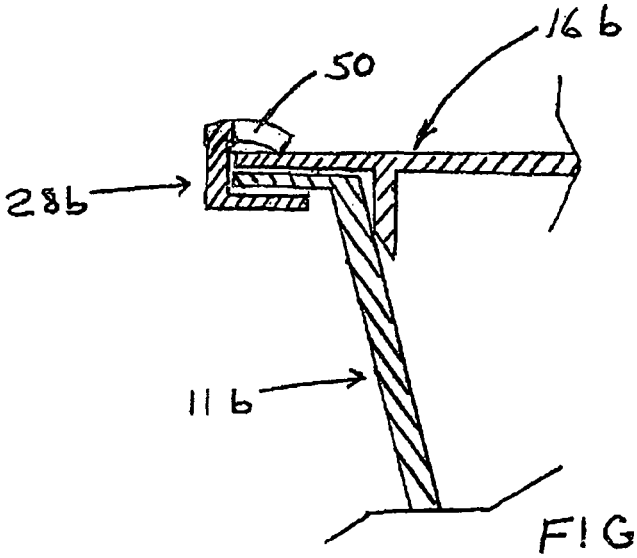
FIG. 10 is a sectional view taken substantially along the lines 10-10 of FIG. 9.

Turning now to FIG. 9, there is shown a variation of the security bands of the invention. In the FIG. 9 embodiment, the initial upstanding wall portion of band is scalloped, formed by petal shaped segments 50 which have been bent over by the mechanical forming process to result in a structure as also depicted in the sectional view of FIG. 10. It is seen from the view of FIG. 10 that the inwardly directed petal shaped segments may be substantially flattened in this sectional view. A flattened structure and increased inward extension of the formed band segments 50 may be obtained with the segmented band compared to a band of continuously uniform cross section such as embodied in the prior figures. One understands that rather than a petal shape, the segments may assume other shapes such as substantially rectangular, triangular, etc.

Figure 11:
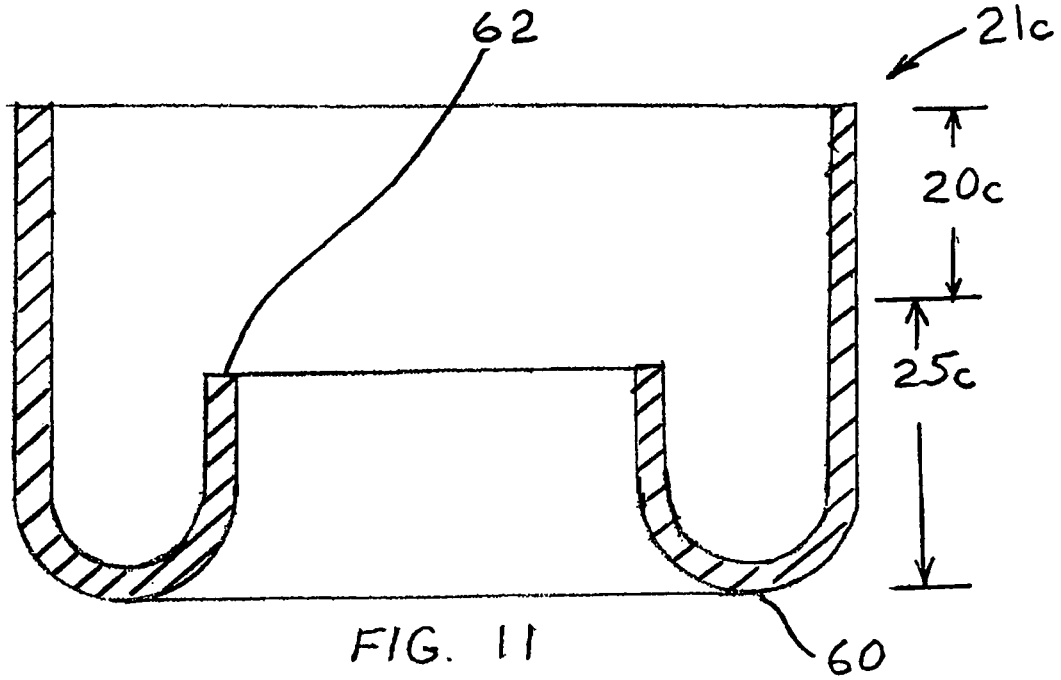
FIG. 11 is a sectional view showing alternate structure for a second portion of a security band.
Figure 12:
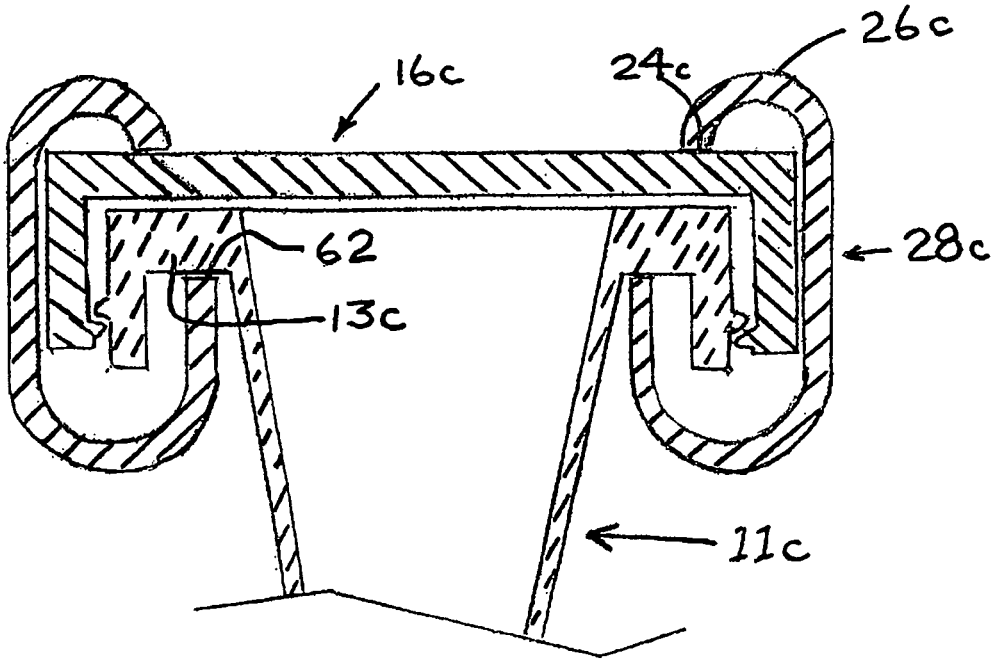
FIG. 12 is a sectional view through an assembly of container, lid and security band showing the structure of the band of FIG. 11 following mechanical forming to produce a curled structure of the first portion of band to extend above the lid.

An additional embodiment of band structure is depicted in cross-section in FIGS. 11 and 12. FIG. 11 depicts a band 21*c* as originally produced prior to application to a package. The "second portion" 25*c* of band 21*c* of FIG. 11 features a "hook-shaped" configuration 60 in place of the inward directed flange 22 of the previous embodiments of FIGS. 1-10. The "hook-shaped" portion terminates at edge 62. One will appreciate that the structure of FIG. 11 can be readily produced using standard plastic processing techniques such as injection molding, thermoforming or stamping.

FIG. 12 is a sectional view through an assembly of container 11*c*, lid 16*c* and security band 28*c* showing the altered structure of the original band 21*c* of FIG. 11 following mechanical forming to produce a curled structure 26*c* of a first band portion extending above the lid 16*c*. In this embodiment, the terminal edge 62 is closely adjacent or in contact with the underside of container lip 13*c* while the distal edge 24*c* of the curled first band portion is closely adjacent or touching the upper surface of lid 16*c*. One understands that plastic fabrication techniques allow for large latitude in design choice for the band structure and that a flat annular flange or alternative "hook-like" embodiments for the "second band portion" represent but a small example of possible structure for this component.

Figure 13:
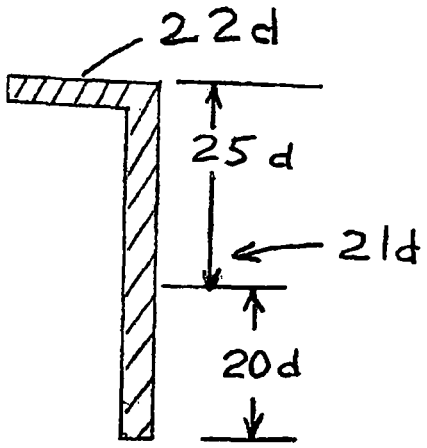
FIG. 13 is a sectional view through another embodiment of security band prior to application to a package.
Figure 14:
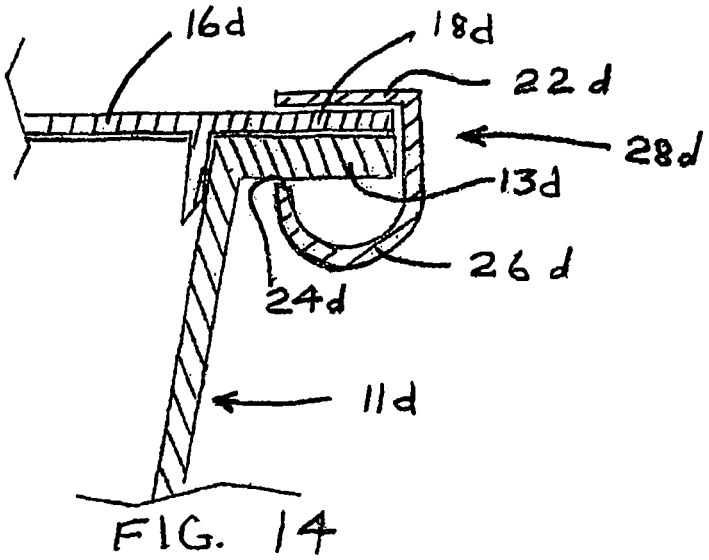
FIG. 14 is a sectional view of a portion of package comprising an assembly of container, lid and security band of FIG. 13 following mechanical forming to curl a first portion of band below a container lip and lid.

Turning now to FIG. 13 there is shown a sectional view of another embodiment of security band of the invention. FIG. 13 embodies a band 21*d* which, in the FIG. 13, appears similar to the bands of prior embodiments such as FIG. 1. However, the band 21*d* of FIG. 13 is designed to be applied with the inward directed flange 22*d* positioned above the top surface of lid 16*d*. This arrangement is depicted in FIG. 14. There it is shown that flange 22*d* is positioned above lid 16*d* and the "first portion" of band is formed into curl structure 26*d*. The distal end 24*d* of curl 26*d* is adjacent or in physical contact with the underside of container lip flange 13*d*. Thus the mechanically formed, curled band 28*d* secures the lid 16*d* to the container 11*d*.

Positioning the "curled" structure beneath the container lip (lower curl) as shown in the FIG. 14 embodiment has some advantages compared to the top surface positioning of the curl (upper curl) embodied in the FIGS. 1-12. With the lower curl, the formed surface is partially hidden beneath the container lip, thereby also hiding any visual defects or blemishes which may occur occasionally in the curled form. This lower visibility of the curled band portion may also allow material reductions through band segmentation, wall thinning etc. Another advantage is the ability to produce a curled form which impacts the container surface in a slight interference fit to produce a preloaded stress. This would prevent repositioning of the band after initial removal. A further advantage to a lower curl is that the upper, highly visible band portion may remain unaltered by the mechanical forming. Thus the upper band portion may be embossed, patterned, decorated or otherwise designed to impart information or distinctiveness. Finally, the upper band portion may be designed to extend inwardly a sufficient amount to retain labels, coupons, etc.

Figure 15:
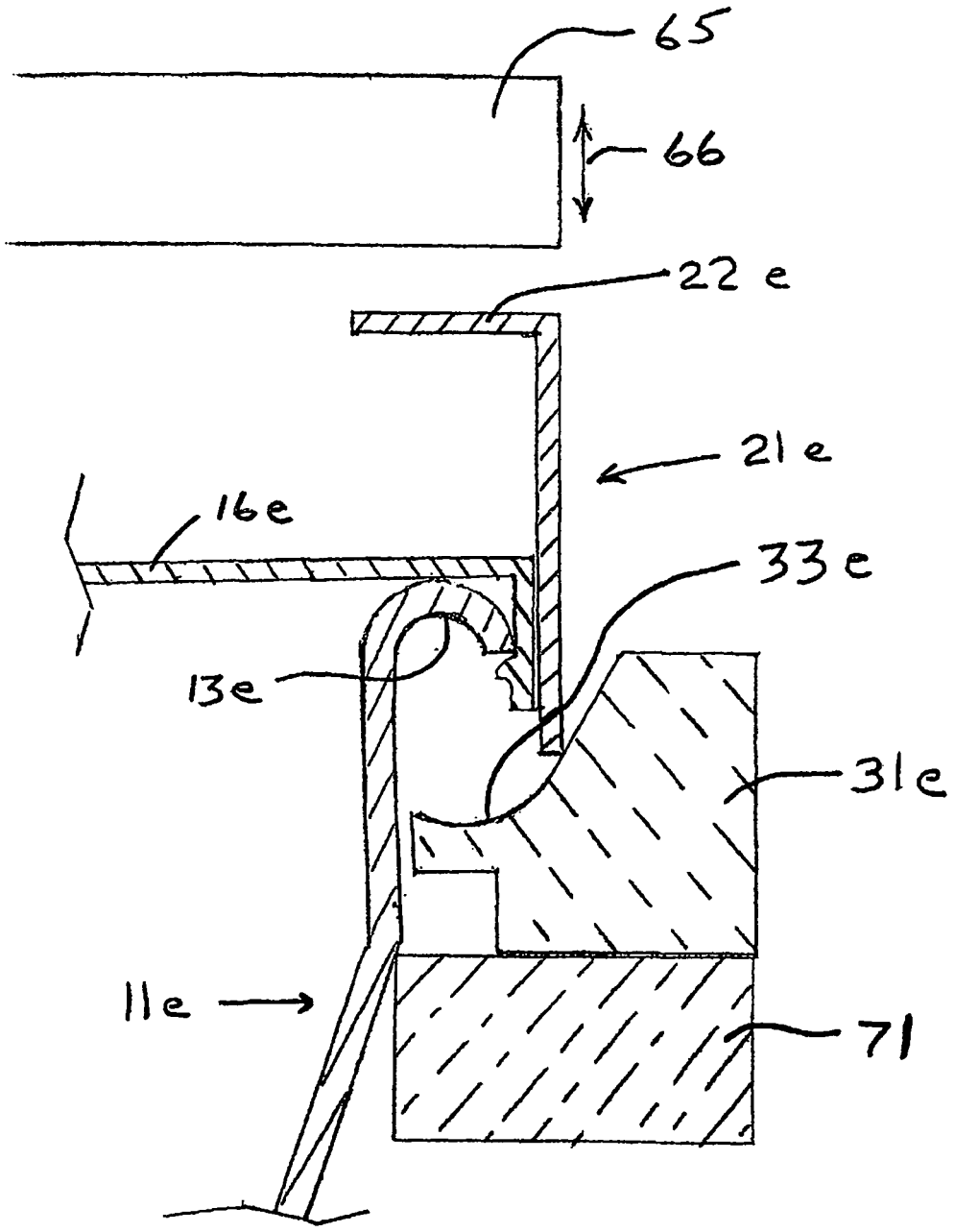
FIG. 15 is a view, partially in section, of portions of a container, a lid, a security band and tooling for mechanical forming, all positioned relative each other prior to the mechanical forming operation.

Reference is now made to FIG. 15, which is a view, partially in section, of portions of a container, a lid, a security band and tooling for mechanical forming, all positioned relative each other prior to the mechanical forming operation. The band 21*e* shown in section in FIG. 15 is similar to the band embodied in FIG. 13 discussed above. Mounting block 71 serves to position the container 11*e* relative the forming tool 31*e*. Forming tool 31*e* comprises a curved, upper surface portion 33*e*. As indicated, surface 33*e* may also serve as a temporary positioning nest for the band after it is place over the container/lid assembly and prior to forming. Pressure plate 65 may be moved unidirectionally (normally vertically) as indicated by arrows 66.

Figure 16:
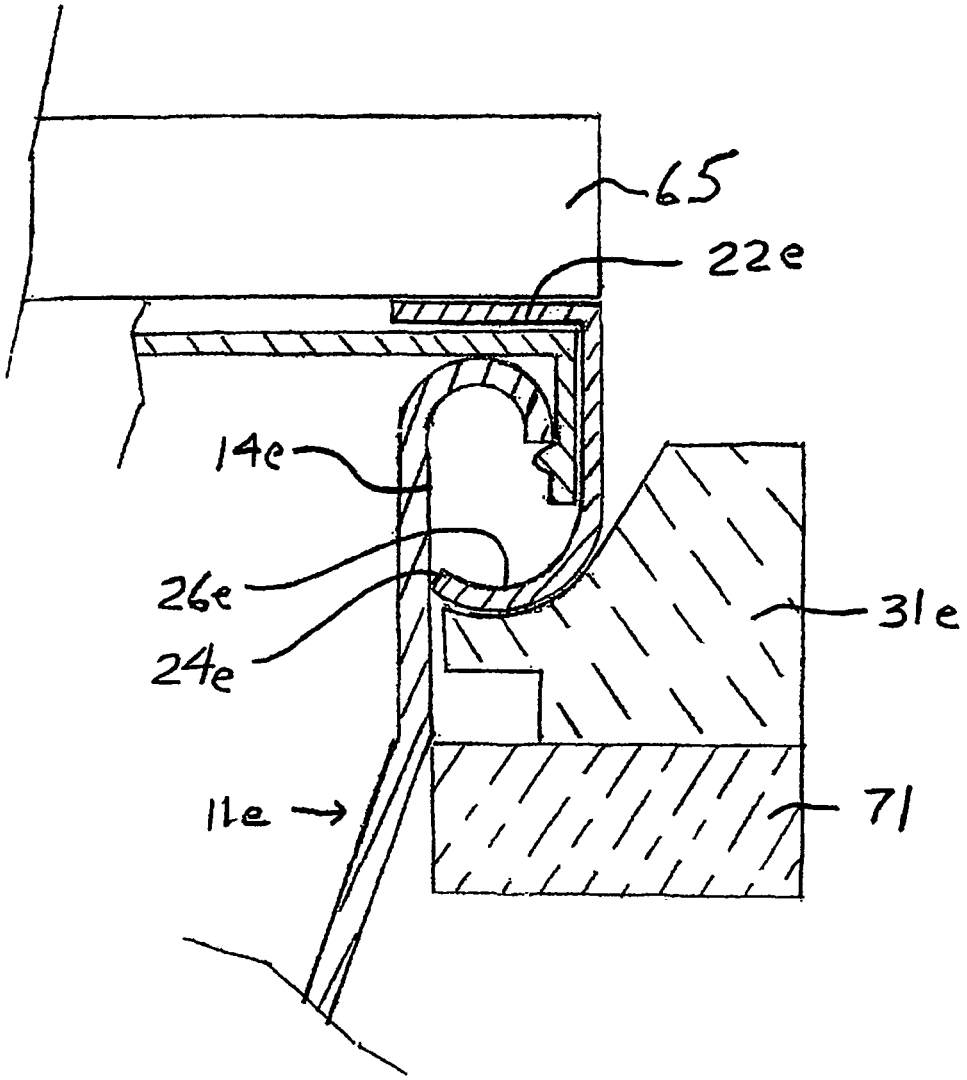
FIG. 16 is a view similar to FIG. 15 showing relative positioning of components after the mechanical forming operation producing a curled band structure.

FIG. 16 is a view similar to FIG. 15 showing relative positioning of components after the mechanical forming operation comprising the relative unidirectional movement of pressure plate 65 and forming tool 31*e*. This movement produces a curled band structure indicated by numeral 26*e*. In the FIG. 16 embodiment, the distal edge 24*e* of curled portion 26*e* is shown in contact with the exterior surface 14*e* of container 11*e*. In embodiments, this contact can create interference such that the band is in slight tension or "spring loaded". This has two results. First, the tension securely retains the band in place (and therefore the lid applied to the container) prior to removal of the band. Secondly, after severing the line of weakness and initial removal of the band, the band cannot be repositioned on the package without an enlargement of the gap at the line of weakness. This latter result significantly improves the shelf visibility of the tamper evidency. Finally, it is pointed out the mechanically formed "curled" structure is relatively rigid and difficult to straighten. Thus it is very difficult to push upward on the band to deform it and slip it off the container and lip peripheral edges enveloped by the band. This feature is an improvement over some tamper evident bands having "bistable" or "V" structures which can often be flipped to relieve the retention engagement.

Figure 17:
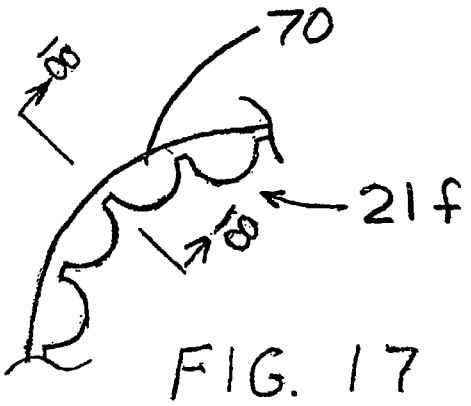
FIG. 17 is a top plan view of a band showing alternate structure.
Figure 18:
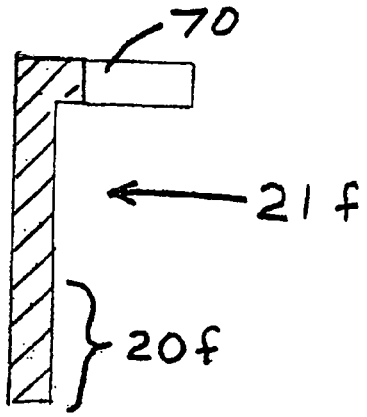
FIG. 18 is a sectional view taken along the lines 18-18 of FIG. 17.
Figure 19:
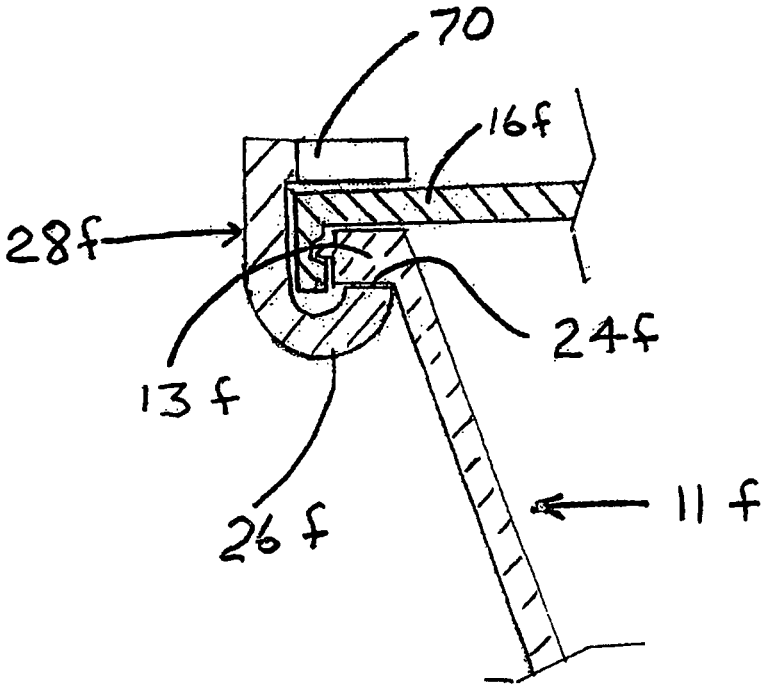
FIG. 19 is a sectional view of a portion of package comprising an assembly of container, lid and the security band of FIGS. 17 and 18 following mechanical forming to curl a first portion of band below a container lip and lid.

Turning now to FIGS. 17-19, there is illustrated another embodiment of a security band 21*f* of the invention. FIG. 17 is a top plan view of band 21*f* and FIG. 18 is a sectional view taken substantially from the perspective of lines 18-18 of FIG. 17. In the FIG. 17 embodiment, a inwardly directed, segmented or 'scalloped" design 70 is substituted for the annular, inwardly directed flange 22*d* of the FIG. 13 embodiment. It is noted that in the FIG. 17 embodiment, the scalloped segments are inwardly directed in the band prior to mechanical forming of the band. This is in contrast to the embodiments of FIGS. 9 and 10 where the inward direction of the scallops was produced by the forming process. Continuing attention to FIGS. 17-18, it is noted that designs such as the scallops indicated may be used to impart product distinction or identity or perhaps to conserve material weight. Turning now to FIG. 19, there is depicted the band of FIGS. 17 and 18 applied to a container 11*f* and lid 16*f* using a mechanical forming process such as embodied in FIGS. 15-16. In FIG. 19 it is seen that application of the band of FIGS. 17 and 18 produces a curled structure 26*f* extending inwardly beneath container lip flange 13*f*. In the FIG. 19 embodiment, the distal edge 24*f* of the curled end portion is closely adjacent or in contact with the underside of container lip flange 13*f*. In this embodiment, "scalloped" structure 70 remains unaltered by the mechanical forming or curling process.

Figure 20:
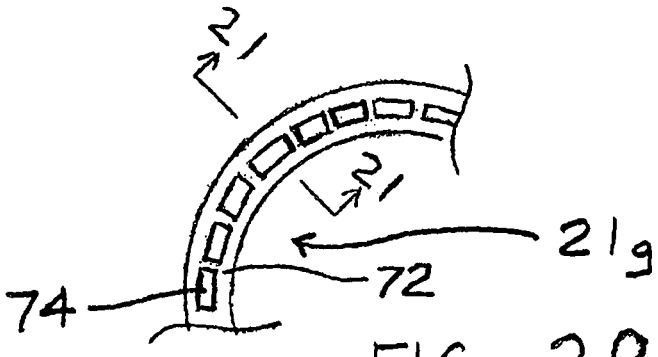
FIG. 20 is a top plan view of a band showing alternate structure.
Figure 21:
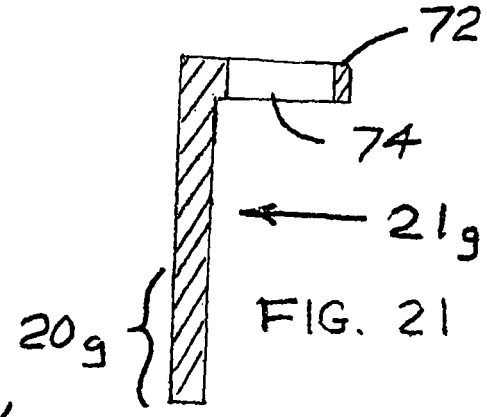
FIG. 21 is a sectional view taken along the lines 21-21 of FIG. 20.
Figure 22:
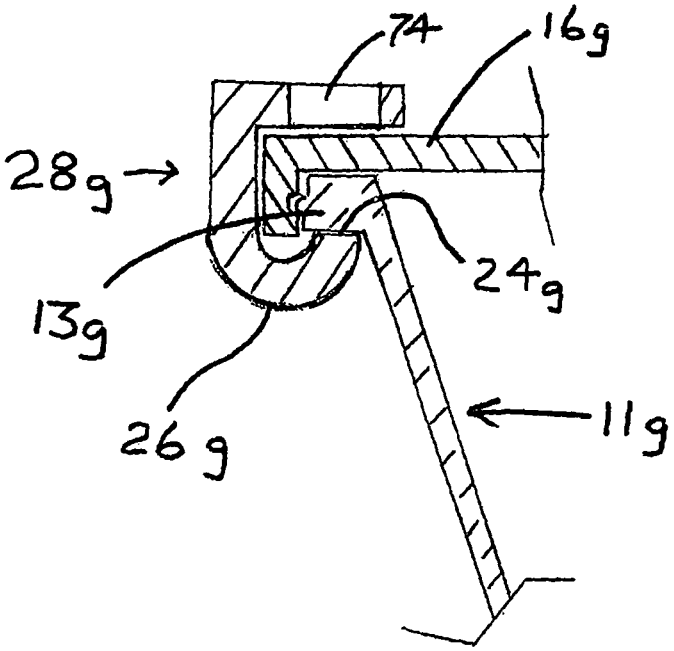
FIG. 22 is a sectional view of a portion of package comprising an assembly of container, lid and the security band of FIGS. 20 and 21 following mechanical forming to curl a first portion of band below a container lip and lid.

Turning now to FIGS. 20-22, an additional embodiment of band is illustrated using perspectives similar to FIGS. 17-19. The band of FIGS. 20-22 comprises an inwardly directed flange 72 having "cutout" portions 74. FIGS. 20 and 21 show views of the band 21*g* as originally produced. FIG. 22 is a sectional view showing the band, now designated 28*g* reflecting the altered structure, after forming and in combination with a container 11*g* and lid 16*g*. As with the "scallop" design of the FIGS. 17-18 band, the "cutout" design of FIGS. 20-22 may save considerable material savings while imparting distinctiveness to the overall package.

Figure 23:
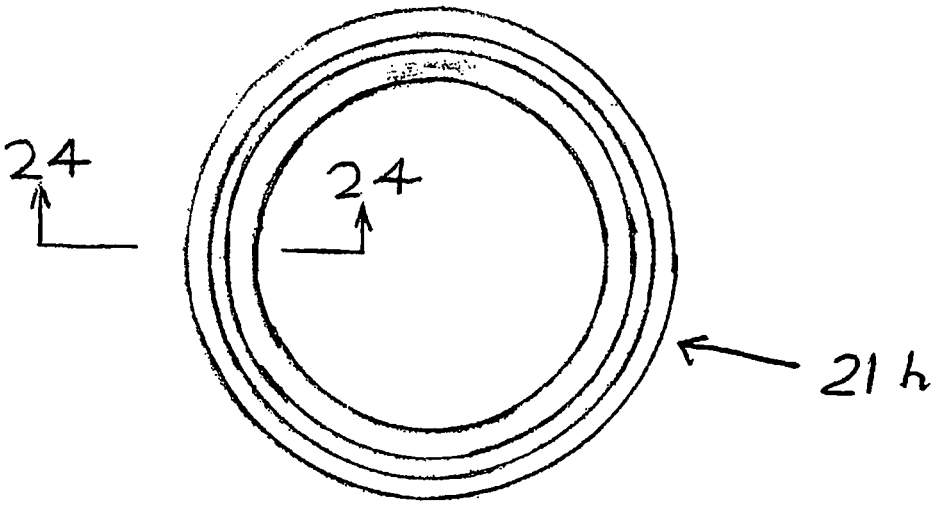
FIG. 23 is a top plan view of another embodiment of security band having additional structure.
Figure 24:
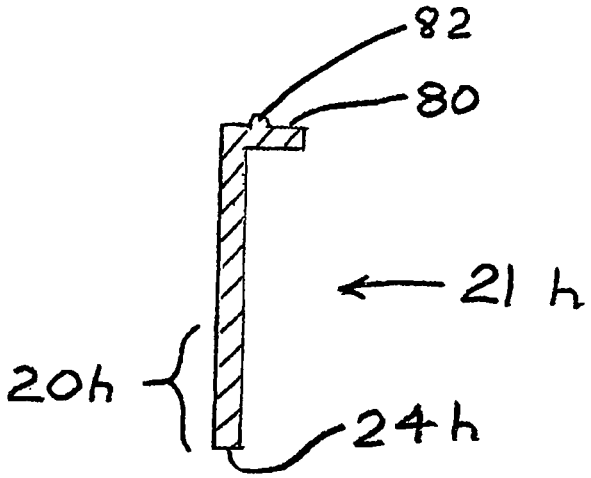
FIG. 24 is a sectional view taken substantially from the perspective of lines 24-24 of FIG. 23.

Turning now to FIGS. 23-24, there is shown an additional possible feature of the tamper evidencing security bands of the invention. The FIGS. 23-24 illustrate a band 21*h* as originally produced and prior to combination with a container and lid. The band 21*h* of FIGS. 23-24 is similar to that of FIGS. 1 and 13 but also comprises structure for stacking of multiple bands for packaging, transit and feeding to a packaging line. In the FIGS. 23-24 embodiment, the stacking structure consists of a simple bead or rib 82 positioned on the outer surface of annular flange 80. The distal end 24*h* of an adjacent band may positioned to encircle bead 82 for stacking of multiple bands. One readily appreciates that other stacking features known in the art may replace or augment the bead 82 embodied in the FIGS. 23-24.

Figure 25:
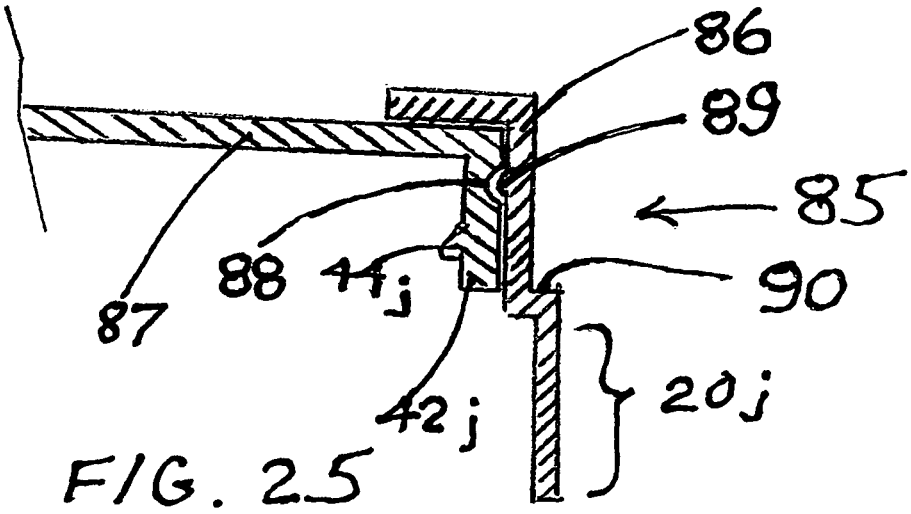
FIG. 25 is a sectional view of an embodiment of an assembly of lid and security band preform prior to application to a container.

Turning now to FIG. 25, there is shown a sectional view of an embodiment of an assembly of lid and security band preform prior to application to a container. This assembly is generally indicated by the numeral 85. Assembly 85 comprises tamper band preform 86 coupled to container lid 87 using detachable engagement structure. In the embodiment, the detachable engagement structure comprises inwardly projecting preform bead 89 nestled within indentation 88 on the outer sidewall of lid skirt 42*j*. Tamper band preform 86 incorporates a step 90 supplying substantially horizontal surfaces both internally and externally. This step allows stacking of multiple assemblies as indicated in FIG. 26.

Figure 26:
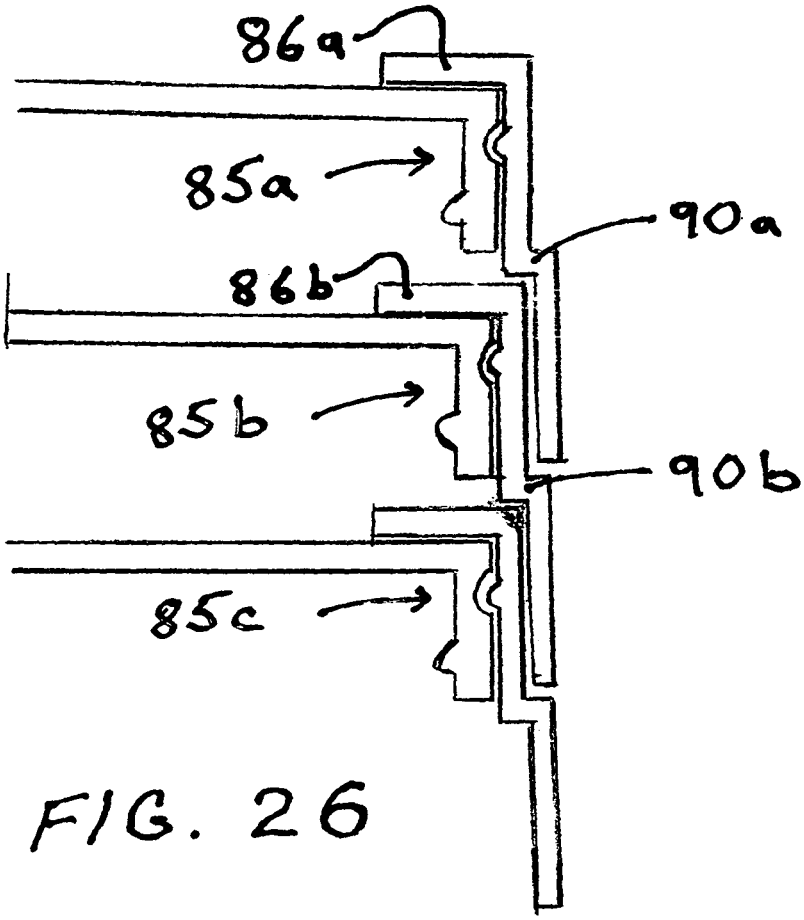
FIG. 26 is a view of multiple assemblies according to FIG. 25 showing a stacking arrangement of the assemblies. In the FIG. 26 sectional lines have been eliminated for clarity of presentation.

FIG. 26 embodies a stack of a multiple of the assemblies of FIG. 25. Sectional lines are omitted in FIG. 26 for clarity. Stacking may result, for example, from resting of the internal horizontal surface of a step 90*a* of assembly 85*a* on the top surface of preform 86*b*. Alternatively, stacking may result from the lower distal end of preform 86*a* resting on the exterior horizontal surface of step 90*b*. One will understand that either of these situations can be repeated to stack many assemblies for shipping or feeding to an assembly process.

Figure 27:
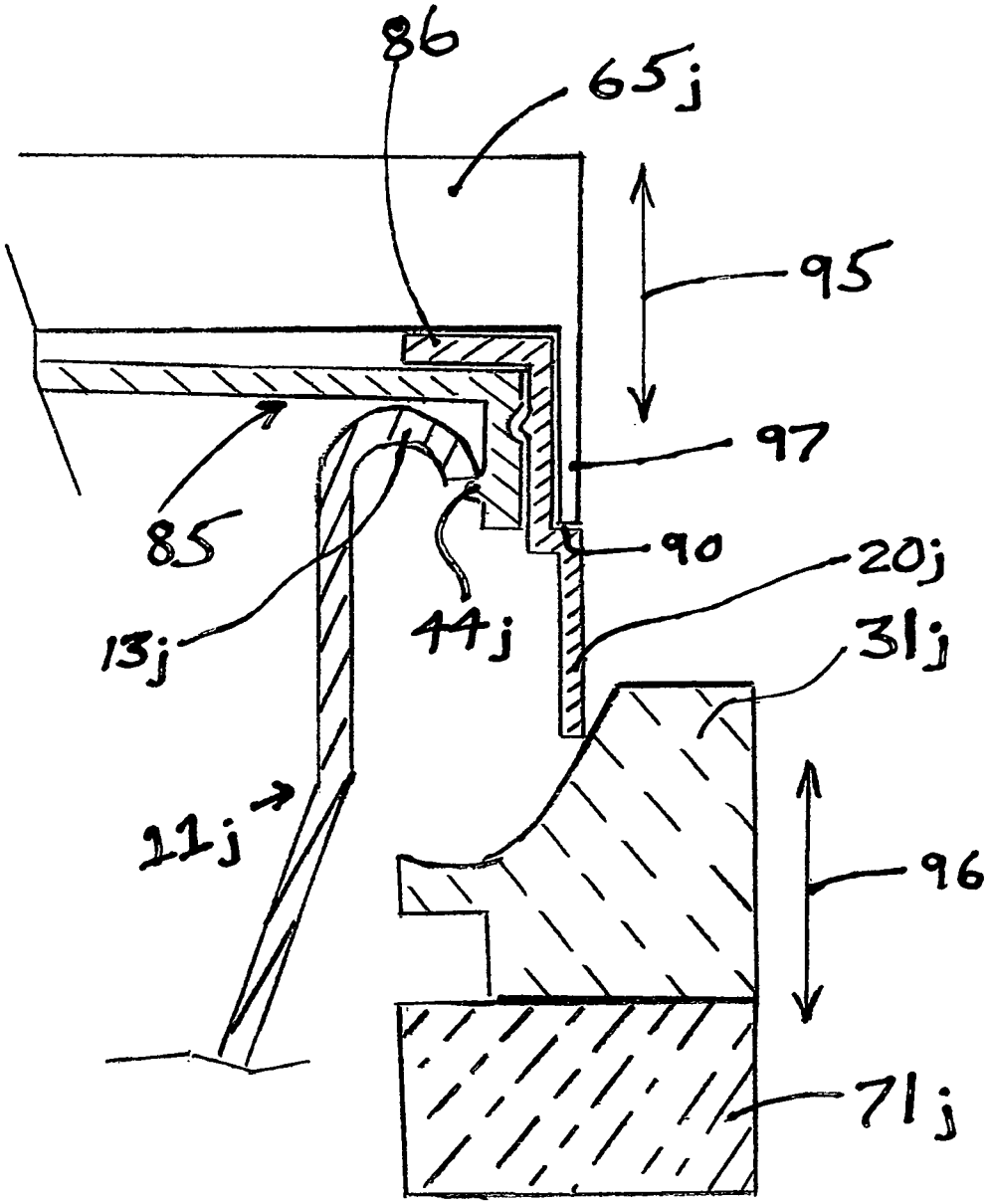
FIG. 27 is a view partially in section showing possible arrangement and motion of tooling during the mechanical forming of the security band subsequent to combination of the assembly of FIG. 25 with a container.

FIG. 27 is a view partially in section showing possible arrangement and motion of tooling during the mechanical forming of the security band subsequent to combination of the assembly of FIG. 25 with a container. In the process embodied in FIG. 27, pressure plate 65*j*, forming tool 31*j* and mounting block 71*j* are moved toward each other as indicated by arrows 95 and 96. One notes that pressure plate 65*j* comprises a downward extension 97 intended to guide the assembly and also rest on the shoulder 90 of preform 86 to support the first portion 20*j* of preform 86 during the mechanical forming process. One will understand that the relative motion of pressure plate 65*j*, forming tool 31*j* and mounting block 71*j* as indicated in FIG. 27 will mechanically form the preform 86 to produce a result according to the embodiment of FIG. 16 above.

Figure 28:
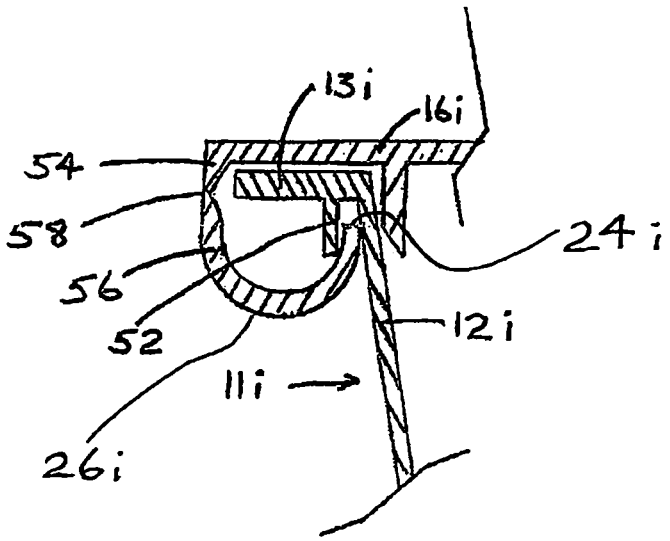
FIG. 28 is a sectional view of a portion of an assembly comprising a container and a lid wherein the lid comprises a depending monolithically formed band and having a portion of the band mechanically formed to a curled structure extending beneath the container lip.

Turning now to FIG. 28, there is illustrated yet another embodiment of the instant invention. In FIG. 28, there is illustrated a container 11*i* comprising flange 13*i* as in previous embodiments. In the FIG. 28 embodiment, container 11*i* also comprises a downward extending wall 52. Lid 16*i* comprises a downward extending portion 54 and also a band 56 joined to portion 54 through a circumferential line of weakness 58. Line of weakness 58 may be formed by multiple material bridges spaced around the circumference or a continuous frangible score line such as produced by a line of thinned material section. As is seen in FIG. 28, a portion of band 56 is formed into a curled structure 26*i* whereby the distal edge 24*i* of the band 56 is inserted into the annular space between the downward extending wall 52 and the container body 12*i*. Initial opening of the package requires removal of the band through fracture of the line of weakness 58. One notes that in contrast to the prior embodiments, the package embodied in FIG. 25 envisions a band and lid joined as an integral unit rather than as separate distinct components. The integral lid/band structure embodied in FIG. 28 may be accomplished using a monolithic material structure wherein a single material extends throughout both the lid and band portions. Alternatively, the integral structure may be achieved by methods such as seaming or 2 part injection of lid and band structures using different materials. In any case, the integral lid/band structure may be placed on the container and the curled structure 26*i* accomplishing tamper evidencing is produced by mechanical forming after the placement in a manner as taught above in this specification.

When comparing the integral band/lid embodiments of FIG. 28 with the prior embodiments of a discrete, separately produced band, one notes that either approach has specific advantages. The integral lid/band approach of FIG. 28 has the apparent advantage of having one less separate part to produce, manage and assemble. Consolidation to reduce part numbers often reduces production cost, material shipping cost, logistics and process complication. On the other hand, such consolidation can lead to complications in other aspects so that the intended benefits are not realized. In contrast, having the band produced separately may allow simplified band production, design flexibility for the band and final package, and package distinction such as may be achieved by band printing, embossing or coloration.

What is claimed:

1. A method of manufacture of a consumer package comprising the steps of, producing a container having an upwardly extending side wall defining the inner horizontal cross section of said container and a container opening, said container further comprising a lip extending outwardly from said side wall at said container opening, said lip defining an outer lip perimeter, separately producing a closure lid designed to cover said container opening, separately producing a band preform comprising a frangible portion and further having structure and composition designed to be mechanically formed, said band comprising a first portion, said first portion having a terminal end which defines a perimeter greater than said outer lip perimeter such that said first portion can be applied over said lip without interference between said terminal end and said lip, filling the container with its contents, after filling the container, combining said band preform, lid, and filled container together to produce a filled and lidded container assembly wherein said closure lid covers said container opening and said band surrounds said lip, said filled and lidded container assembly being absent frangible connection between the band and the container, after said step of combining said band preform, lid and filled container together, mechanically forming said first portion of said band preform such that said first portion extends to overlap said container lip so that said frangible portion must be broken in order to allow removal of said band from said package and thereby allow said closure lid to be removed from said container, and wherein any mechanical forming of said band after said combining step is accomplished by forming tool movement which is absent a horizontal component relative to said inner container horizontal cross section.

2. The method of manufacture of claim 1 wherein said mechanically forming step produces a curled structure.

3. The method of manufacture of claim 1 wherein said container is in the form of a dish or cup.

4. The method of manufacture of claim 1 wherein said lid has a downward depending outer skirt, and said outer skirt has an inner wall dimensioned to surround said container lip, and wherein said downward depending outer skirt inner wall comprises structure complimentary to structure on said lip to improve detachable engagement of said lid to said container.

5. The method of manufacture of claim 1 wherein said band preform and said closure lid are detachably joined in an assembled combination prior to subsequent combining of said assembled combination with said filled container.

6. The method of manufacture of claim 1 wherein said mechanically formed first portion has a segmented structure.

7. The method of manufacture of claim 1 wherein said mechanically formed first portion is positioned above said container lip after said mechanical forming.

8. The method of manufacture of claim 1 wherein said mechanically formed first portion is positioned below said container lip after said mechanical forming.

9. The method of manufacture of claim 1 wherein said band preform comprises a second portion extending to overlap said container lip and said second portion remains unaltered by said mechanical forming step.

10. The method of manufacture of claim 9 wherein said band further comprises a substantially straight wall portion, said wall portion extending between said first and second band portions.

11. The method of manufacture of claim 1 wherein said band comprises structure to facilitate breakage of said frangible portion of said band without additional tools.

12. The method of manufacture of claim 1 wherein said band includes embossing, texture, lettering, or other molded-in design.

13. The method of manufacture of claim 1 wherein said band contains informational matter, said informational matter being visible prior to initial opening of said consumer package.

14. The method of manufacture of claim 1 wherein, said band is of color different than one or both of said closure lid or said container.

15. The method of manufacture of claim 1 wherein said band preform comprises structure to facilitate stacking of a multiple of said bands.

16. The method of manufacture of claim 15 wherein said band preform comprises an annular exterior surface extending inwardly from an outer edge of said preform and said structure to facilitate stacking comprises a raised portion of said exterior surface.

17. The method of manufacture of claim 1 wherein said container opening is non-circular.

18. The method of manufacture of claim 1 wherein said band is produced by injection molding and comprises has a second portion having a terminal end defining a perimeter less than the outer lip perimeter prior to said combining step, said second portion remaining unaltered after said injection molding.

19. A method of manufacture comprising the steps of, producing a container having an upwardly extending side wall defining the inner horizontal cross sectional area of said container, and a container opening, said container further comprising a lip extending outwardly from said side wall at said container opening, separately producing a closure lid designed to cover said container opening, said closure lid comprising first detachable engagement structure, separately producing a band preform comprising second detachable engagement structure complementary to and engageable with said first detachable engagement structure, said band preform further comprising a frangible portion and further having structure and composition designed to be mechanically formed, forming an assembly comprising a combination of said band preform and said lid by attachment of said first detachable engagement structure to said second detachable engagement structure, said assembly being produced absent said container, while maintaining said attachment intact, applying said assembly comprising a combination of the band preform and the lid to the container to produce a lidded container assembly wherein said closure lid covers said container opening and said band preform extends around said lip, after applying the assembly comprising a combination of the band preform and the lid to the container, mechanically forming a first portion of said band preform such that said first portion extends to overlap said container lip so that said frangible portion must be broken in order to remove said band from said closure lid and said container and thereby allow said closure lid to be removed from said container.

20. The method of claim 19 wherein a multiple of said assemblies comprising a combination of a said band preform and a said lid are combined in a stack arrangement absent a said container.

* * * * *